US005824978A

United States Patent [19]

Karasik et al.

[11] Patent Number: 5,824,978

[45] Date of Patent: Oct. 20, 1998

[54] MULTIPLE DETENT MEMBRANE SWITCH

[75] Inventors: Boris G. Karasik; Vladimir G. Karasik, both of Walled Lake, Mich.

[73] Assignee: UT Automotive, Inc., Dearborn, Mich.

[21] Appl. No.: 882,844

[22] Filed: Jun. 26, 1997

[51] Int. Cl.[6] ..... H01H 13/14

[52] U.S. Cl. ..... 200/1 B; 200/5 A; 200/513

[58] Field of Search ..... 200/1 B, 5 A, 200/512, 513, 517; 400/472, 490

[56] References Cited

U.S. PATENT DOCUMENTS

| | | | |
|---|---|---|---|
| 3,996,429 | 12/1976 | Chu et al. | 200/5 A |
| 4,376,238 | 3/1983 | Martin | 200/1 B |
| 4,668,843 | 5/1987 | Watanabe et al. | 200/5 A |
| 5,313,027 | 5/1994 | Inoue et al. | 200/5 A |
| 5,350,890 | 9/1994 | Fairbrother et al. | 200/5 A |
| 5,510,584 | 4/1996 | Norris | 200/5 A |
| 5,559,311 | 9/1996 | Gorbatoff | 200/513 |

OTHER PUBLICATIONS

United States Patent Application, Multiple Detent Membrane Switch, AG–1357 IC–EM, Ser. No.: 08/680,623, Filed: Jul. 17, 1996 Inventor: Jonathan Dahlstrom.

*Primary Examiner*—Michael A. Friedhofer
*Attorney, Agent, or Firm*—Granetta M. Coleman

[57] ABSTRACT

An improved membrane switch includes multiple detents. A pair of electric circuits are completed by the membrane switch. The switch includes the pair of open electric circuits, three flexing areas, and two membrane contacts. Normally the flexing areas bias the membrane contacts out of contact with the electric circuits. When a first actuation force is applied to the membrane, the intermediate flexing area flexes allowing the first circuit to be complete by the first membrane contacts. When a second actuation force is applied to the membrane, the center and outer flexing areas flex allowing the second circuit to be completed by the second membrane contacts. The inventive membrane switch provides the operator with a clear indication and a detent feel for each of the two circuits.

10 Claims, 1 Drawing Sheet

MULTIPLE DETENT MEMBRANE SWITCH

TECHNICAL FIELD

The present invention relates to switches, and more particularly to multiple detent switches wherein at least two electric circuits may be completed by a membrane switch.

BACKGROUND OF THE INVENTION

Electrical switches are utilized in increasingly greater numbers in today's vehicles. The operator of a modern vehicle is provided with many different control options, and thus, more and more electric switches are required. Vehicle switches typically include several different mechanical pieces, and assembly is time consuming and costly. Moreover, these mechanical switches have also sometimes been subject to failure.

As one example, there are known switches that can receive serial actuation to indicate different desired switch functions. Window switches are known wherein a first actuation of the switch causes the window to stop at a desired intermediate location. This is a manual mode of operation. A second serial actuation of the switch causes the window to move completely upwardly or downwardly. This is an automatic or express mode. This type of switch becomes quite complex and expensive to provide.

It is a goal of all vehicle assemblers to decrease the complexity and expense of the components. Thus, less expensive and complex electric switches are desired.

Membrane switches are known wherein a membrane has a relaxed position at which it holds two electric contact members out of contact. The membrane switch has a flexing area that can be flexed by an operator to allow the electric contacts to move toward each other. Membrane switches have fewer working parts than the prior art mechanical switches, and thus have some desirable characteristics. However, the known membrane switches have only been utilized to actuate single circuits, and thus have been less widely utilized than may be desirable.

SUMMARY

According to an embodiment of the present invention, a membrane switch includes an first open circuit, a second open circuit, and a membrane. The first open circuit includes a pair of spaced first circuit contacts. The second open circuit includes a pair of spaced second circuit contacts. The membrane includes three flexing areas. The flexing areas from radially innermost to outermost are a center flexing area, an intermediate flexing area and an outer flexing area. The membrane further includes two membrane contacts. The first membrane contact is disposed on or about the centerline of the membrane switch. The second membrane contact is disposed between the intermediate and outer flexing areas. The membrane is formed so that the flexing areas bias the first and second membrane contacts out of contact with said first and second associated circuit contacts.

In order to complete the first circuit, a first actuation force must be exerted on the membrane. This flexes the intermediate flexing area causing the first membrane contact to contact the first circuit contact closing the first circuit. In order to complete the second circuit, a second actuation force must be exerted on the membrane. This second force flexes the center and outer flexing areas causing the second membrane contact to contact the second circuit contact closing the second circuit. The second actuation force also causes the intermediate flexing area to flex as necessary to allow a substantially normal force to be exerted on the first membrane contact, which ensures that the first circuit will remain closed.

In another embodiment the membrane switch further includes a button for transmitting the actuation force of an operator to the membrane.

The foregoing invention will become more apparent in the following detailed description of the best mode for carrying out the invention and in the accompanying drawings.

BEST MODE FOR CARRYING OUT AN EMBODIMENT THE INVENTION

Figure 1:
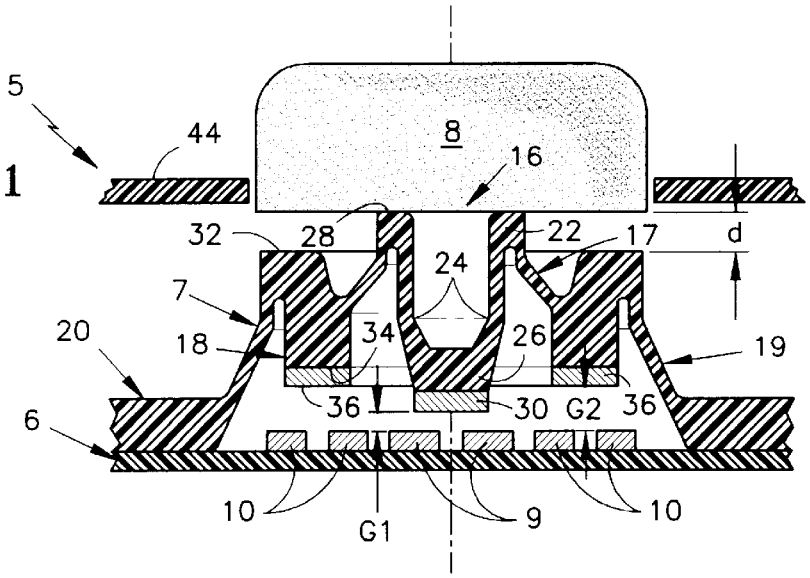
FIG. 1 is a cross-sectional view of a multiple detent membrane switch of the present invention with both circuits open.

Referring to FIG. 1, a multiple detent membrane switch 5 includes a printed circuit board 6, a membrane 7, and a button 8.

The printed circuit board 6 includes first and second open circuits mounted thereon. The first open circuit includes a pair of inner, spaced first electric contacts 9. The second open circuit includes a pair of outer, spaced second electric contacts 10. The pairs of second contacts 10 are spaced outwardly from the first contacts 9. The contacts 9 and 10 are shown schematically, and it should be understood that the contacts 9 and 10 would each complete a circuit when the switch operates as discussed below.

The membrane 7 is resiliently deformable dome disposed upon the printed circuit board 6. The membrane 7 includes a center column 16, a conical intermediate flexing area 17, a third planar area 18, a conical outer flexing area 19, and a fourth planar area 20.

The center column 16 includes a first planar area 22, a center flexing area 24, and a second planar area 26. The first planar area 22 is a ring including an upper surface, which is the upper actuation surface 28. Surface 28 is engaged by the button 8.

The center flexing area 24 is an axially extending tube with a narrowing end portion. The flexing area 24 extends from the lower surface of the first planar area 22 to the upper surface of the second planar area 26.

The second planar area 26 closes one end of the tubular center flexing area 24, and is disposed on the centerline of the membrane. The second planar area 26 is axially spaced from and radially inward of the first planar area 22. The lower surface of the second planar area 26 has a first membrane contact 30 position thereon. When the switch 5 is in the open position (as shown in FIG. 1), the first contact 30 is spaced from the first contacts 9, forming a gap G1 therebetween.

The intermediate flexing area 17 extends from the lower surface of the first planar area 22. The intermediate flexing area 17 is radially outward of the center flexing area 24.

The third planar area 18 is a ring, which is radially outward from the center column 16. The third planar area 18 includes an upper surface, which is the lower actuation surface 32. The lower actuation surface 32 is axially spaced below the upper actuation surface 28 of the first planar area 22 a distance, represented by the arrow d. Thus, the upper actuation surface 28 extends above the lower actuation surface 32, when the membrane is in the initial position.

The intermediate flexing area 17 extends radially between the first and third planar areas 22 and 18, respectively. The third planar area 18 further includes a lower surface 34. The lower surface 34 has a second membrane contact 36 positioned thereon. When the switch 5 is in the open position, the second contact 36 is spaced from the second contacts 10, forming a gap G2 therebetween.

The outer flexing area 19 extends from the third planar area 18. The outer flexing area 19 is radially outward of the second contact 36.

The fourth planar area 20 is a ring which is radially outward from the third planar area 18. The fourth planar area 20 acts as the membrane base. The lower surface of the fourth planar area 20 rests upon the printed circuit board 5. The outer flexing area 19 extends radially outwardly between the third and fourth planar areas 18 and 20, respectively.

The button 8 extends through a housing 44, shown here schematically, and is accessible to an operator of a vehicle. In another embodiment, other configurations for the button may be used or other types of components or linkages may allow the operator to actuate the membrane switch.

It is preferred that the arrangement of the switch be as shown in the drawing. The second contacts 36 may be a generally cylindrical rings or may be circumferentially spaced contacts. The outer contacts 10 may be generally cylindrical rings or may be spaced contacts having a different geometry.

The design and manufacture of the flexing areas 24, 17 and 19 that can move to a flex position, as discussed below, is within the skill of a worker in the membrane switch art. Single detent membrane switches have been developed, and the known flexing technology utilized there is sufficient for purposes of this invention.

A recommended material for the membrane includes but is not limited to a non-conductive silicone rubber compound. Some of the factors which should be considered when selecting the membrane material are tensile strength, ultimate elongation, dielectric strength, volume resistivity, temperature range, contact resistance, and pressure to activate conductive rubber. A recommended material for the membrane contacts includes but is not limited to a conductive silicone rubber compound.

Figure 2:
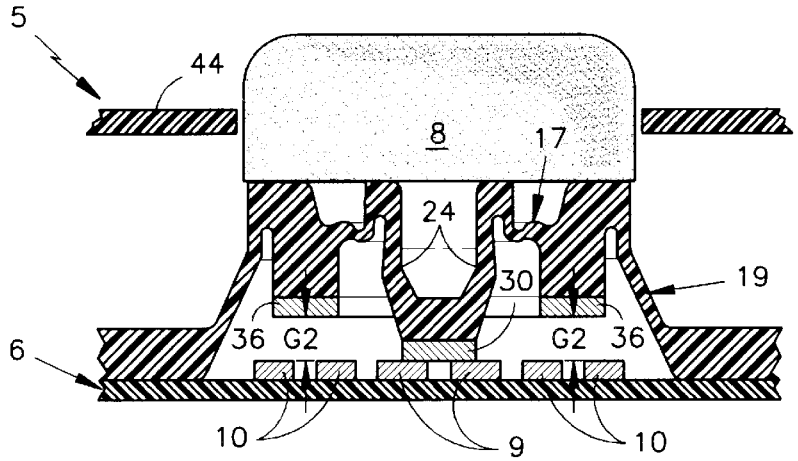
FIG. 2 is a cross-sectional view of the switch of FIG. 1 with a first circuit closed.
Figure 3:
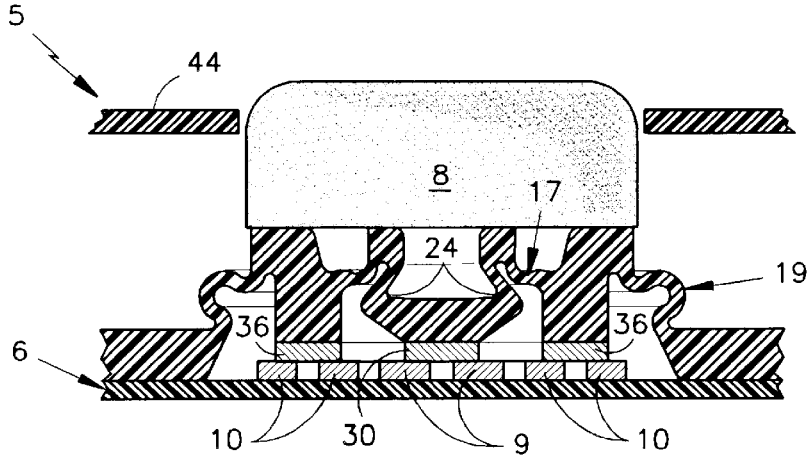
FIG. 3 is a cross-sectional view of the switch of FIG. 1 with both circuits closed.

Operation of the membrane switch 5 will now be discussed with reference to FIGS. 1–3. The first circuit is closed by pressing the button 8 inwardly with respect to the housing 44. A first actuation force is required. This force exerted by the button 8 on the upper actuation surface 28 of the first planar area 22 exerts a sufficient force on the membrane to cause the intermediate flexing area 17 to flex. Consequently, the upper actuation surface 28 of the first planar area aligns with the lower actuation surface 32 of the third planar area 18. The intermediate flexing area 17 has flexed into its flexed position. Consequently, the first membrane contact 30 contacts the first circuit contacts 9, and the first circuit closes (as shown in FIG. 2). Second contacts 36 and 10 remain out of contact, and thus the second circuit is open.

Should the operator desire to complete the second circuit, the button 8 is pressed further inwardly. A second actuation force is required. The center flexing area 24 and the outer flexing area 19 flex to their flexed orientation (as shown in FIG. 3), and the second membrane contact 36 now contacts the second circuit contacts 10. The gap G2 is closed, and the first and second circuits are now completed. The second actuation force causes a substantially normal force to be exerted on the first membrane contact, thus ensuring the first circuit remains closed.

The operator is provided with a clear indication of the completion of the first detent as shown at FIG. 2, and knows to stop actuation, if it is not desired to complete the second circuit. At the same time, the operator is also provided with a clear indication of when the second detent is completed to complete the second circuit. The switch 5 maintains the positions shown in FIGS. 2 and 3 until the button 8 is released. Once released, the flexing areas 24, 17, and 19 return the switch to the FIG. 1 orientation. The switch is able to control two circuits with a minimum of parts.

As one example of a potential use for the switch, the first detent and circuit can be utilized to cause a window to stop at a desired intermediate location. The second circuit could be utilized to provide an indication that the operator would like the window movement to move completely upwardly or downwardly. The use of the single membrane switch provides this dual switching ability with a minimum of parts and complexity for the required switching elements.

While a particular invention has been described with reference to illustrated embodiments, various modifications of the illustrative embodiments, as well as additional embodiments of the invention, will be apparent to persons skilled in the art upon reference to this description without departing from the spirit and scope of the invention, as recited in the claims appended hereto. In addition to applications in the automotive field this invention can be used in the following applications but is not limited thereto, such as computer keyboard applications, electronic panels, and phones. It is therefore contemplated that the appended claims will cover any such modification or embodiments that fall within the true scope of the invention.

We claim:

1. A membrane switch comprising:

a membrane having a center, intermediate, and outer flexing areas and first and second membrane contacts, said membrane positioned adjacent first and second circuit contacts associated with each of said first and second membrane contacts; and said center, intermediate and outer flexing areas normally biasing said first and second membrane contacts out of contact with said first and second circuit contacts, and a first actuation force on said membrane flexing said intermediate flexing area and causing said first membrane contact to contact said first circuit contact, and a second actuation force flexing said center and outer flexing areas and causing said second membrane contact to contact said second circuit contact.

2. The membrane switch of claim 1, wherein said second actuation force is a normal force on the center of said membrane.

3. The membrane switch of claim 1, wherein said second membrane contact is positioned radially outwardly of said first membrane contact.

4. The membrane switch of claim 3, wherein said intermediate flexing area is radially between said first and second membrane contacts.

5. The membrane switch of claim 1, wherein a button is formed on said membrane in a generally center location, said button providing an operator with a location to apply said first and second actuation forces.

6. The membrane switch of claim 5, wherein said first membrane contact is aligned with a center of said button.

7. The membrane switch of claim 1, wherein said first and second circuit contacts are mounted on a printed circuit board.

8. The membrane switch of claim 1, wherein said membrane further includes an upper actuation surface; and a coaxial, lower actuation surface circumscribing said upper actuation surface below said upper actuation surface, said intermediate flexing area extending between said upper actuation surface and said lower actuation surface, such that said first actuation force acts on said upper actuation surface and said second actuation force acts on said lower actuation surface.

9. A membrane switch comprising:

a printed circuit board including a first open circuit mounted thereon, said first open circuit including a pair of spaced first circuit contacts; and a second open circuit mounted thereon, said second open circuit including a pair of spaced second circuit contacts;

a membrane including an upper actuation surface;

a coaxial, lower actuation surface circumscribing said upper actuation surface below said upper actuation surface;

center, intermediate, and outer flexing areas, said intermediate flexing area extending between said upper actuation surface and said lower actuation surface, said center flexing area is radially inward of said intermediate flexing area, and said outer flexing area extending radially outward from said lower actuation surface; and first and second membrane contacts, said first membrane contact being coupled to the upper actuation surface via said center flexing area, said second membrane contact being coupled to said lower actuation surface, said membrane positioned upon said printed circuit board such that said first and second membrane contacts are aligned to complete said first and second circuits, said center, intermediate and outer flexing areas normally biasing said first and second membrane contacts out of contact with said first and second circuit contacts; and a button is formed on said membrane adjacent said upper actuation surface, said button providing an operator with a location to apply first and second actuation forces, such that upon exerting said first actuation force on said button, said button transfers said first actuation force to said upper actuation surface flexing said intermediate flexing area and causing said first membrane contact to contact said first circuit contact closing said first circuit, and such that upon exerting said second actuation force on said button, said button transfers said second actuation force to said lower actuation surface flexing said center and outer flexing areas and causing said second membrane contact to contact said second circuit contact closing said second circuit.

10. A method of switching comprising the steps of:

providing a switch having a membrane having radially spaced center, intermediate, and outer flexing areas and a first and second membrane contacts, said membrane switch being positioned adjacent first and second circuit contacts for each of said first and second membrane contacts;

providing a first actuation force on said membrane flexing said intermediate flexing area and causing said first membrane contact to contact said first circuit contact; and providing a second actuation force on said membrane flexing said center and outer flexing areas and causing said second membrane contact to contact said second circuit contact, and exerting a substantially normal force on said first membrane contact.

* * * * *